United States Patent [19]

Smith

[11] Patent Number: 5,002,649

[45] **Date of Patent: * Mar. 26, 1991**

[54] SELECTIVE STRIPPING APPARATUS

[75] Inventor: Gary W. Smith, North Olmsted, Ohio

[73] Assignee: SIFCO Industries, Inc., Cleveland, Ohio

[ * ] Notice: The portion of the term of this patent subsequent to Aug. 1, 2006 has been disclaimed.

[21] Appl. No.: 362,749

[22] Filed: Jun. 7, 1989

Related U.S. Application Data

[63] Continuation-in-part of Ser. No. 174,431, Mar. 28, 1988, Pat. No. 4,853,099.

[51] Int. Cl.[5] ..... C25F 5/00; C25F 7/00

[52] U.S. Cl. ..... 204/224 M; 204/237; 204/272; 204/273; 204/275; 156/345; 156/642; 156/656

[58] Field of Search ..... 204/224 M, 272, 237, 204/293, 146, 129.5; 156/642, 656, 345; 134/166 R, 169 R; 118/72, 73, 56, 600

[56] References Cited

U.S. PATENT DOCUMENTS

| | | | |
|---|---|---|---|
| 2,406,956 | 9/1946 | Matthews | 204/272 |
| 2,431,948 | 12/1947 | Martz | 204/272 |
| 2,431,949 | 12/1947 | Martz | 204/235 |
| 3,022,232 | 2/1962 | Bailey et al. | 204/36 |
| 3,065,153 | 11/1962 | Hough et al. | 204/26 |
| 3,276,978 | 10/1966 | Spaulding et al. | 204/45 |
| 3,488,713 | 1/1970 | Hoornstra | 156/345 X |
| 3,496,046 | 2/1970 | Lootvoet | 156/345 |
| 3,499,830 | 3/1970 | Haggerty et al. | 204/224 |
| 3,751,313 | 8/1973 | Di Benedetto et al. | 156/656 |
| 3,751,346 | 8/1973 | Ellis et al. | 204/26 |
| 3,804,725 | 4/1974 | Haynes | 204/26 |
| 3,840,440 | 10/1974 | Durin | 204/25 |
| 3,891,515 | 6/1975 | Paulson et al. | 204/26 |
| 3,891,534 | 6/1975 | Cordone et al. | 204/272 |
| 3,909,368 | 9/1975 | Raymond et al. | 204/26 |
| 3,922,208 | 11/1975 | Cordone et al. | 204/16 |
| 3,929,592 | 12/1975 | Klingernmaier | 204/26 |
| 3,956,096 | 5/1976 | Paulson et al. | 204/237 |
| 3,974,042 | 8/1976 | Angelini | 204/25 |
| 4,019,969 | 4/1977 | Golebiowski et al. | 204/26 |
| 4,028,198 | 6/1977 | Tuscher et al. | 204/9 |
| 4,096,042 | 6/1978 | Looney et al. | 204/1.5 |
| 4,104,133 | 8/1978 | Brannan et al. | 204/25 |
| 4,111,761 | 9/1978 | LaBoda | 204/26 |
| 4,125,447 | 11/1978 | Bachert | 204/222 |
| 4,210,497 | 7/1980 | Loqvist et al. | 204/26 |
| 4,227,986 | 10/1980 | Loqvist et al. | 204/209 |
| 4,246,088 | 1/1981 | Murphy et al. | 204/181 R |
| 4,253,917 | 3/1981 | Wang | 204/16 |
| 4,274,925 | 6/1981 | Bassler | 204/26 |
| 4,279,706 | 7/1982 | Blanc et al. | 204/26 |
| 4,294,670 | 10/1981 | Raymond | 204/26 |
| 4,345,977 | 8/1982 | Blanc et al. | 204/26 |
| 4,352,727 | 10/1982 | Metzger | 204/272 |
| 4,384,926 | 5/1983 | Wagner | 204/26 |
| 4,425,197 | 1/1984 | Inoue | 204/25 |
| 4,427,498 | 1/1984 | Wagner | 204/26 |
| 4,430,167 | 2/1984 | Inoue | 204/25 |
| 4,441,966 | 4/1984 | Onda et al. | 204/26 |
| 4,441,976 | 4/1984 | Iemmi et al. | 204/224 M |
| 4,473,445 | 9/1984 | Smith et al. | 204/26 |
| 4,482,425 | 11/1984 | Battey | 156/656 X |
| 4,543,172 | 9/1985 | Suzuki et al. | 204/224 R |
| 4,555,321 | 11/1985 | Wicks | 204/26 |
| 4,624,750 | 11/1986 | Malagola et al. | 204/26 |
| 4,687,562 | 8/1987 | Smith et al. | 204/206 |
| 4,690,747 | 9/1987 | Smith et al. | 204/206 |
| 4,853,099 | 8/1989 | Smith | 204/237 X |

*Primary Examiner*—Donald R. Valentine

*Attorney, Agent, or Firm*—Body, Vickers & Daniels

[57] ABSTRACT

An apparatus for electroplating a selected surface of a workpiece, or electrolytically or chemically stripping a plating therefrom, comprises an electrode or center constrictor member having an active surface with a selected shape to combine with the selected surface of the workpiece to define an elongated gap of at least about 0.050 inches therebetween, means for supporting this constrictor member in a fixed position to define the elongated gap; solution circulating means for forcing a stripping solution through the gap in a generally closed path at a velocity to exchange stripping solution in the gap at a rate of at least 25 times per minute. When used for either electroplating or electrolytically stripping, the apparatus is provided with means for applying current flow between the selected workpiece surface and the active surface of the electrode through the gap at a current density of at least 2.0 amperes/in$^2$.

23 Claims, 6 Drawing Sheets

252
+
80
250
218
216
66
64
230
214
232
224
32
A
200
222
220
240
242
6
6
210
212
202
204
208
20
206
14
a=1.62
g=.625
(.050-2.0)
6 HOURS
0.050 INCHES
S
g
170
5
5
b
b=1.50
A=30 AMP
FLOW=300
GAL/HR
10
40
300
146
12
142
3
3
104
100
192
190
102
140
144
f
148
106
160
Ae≐Aa
>Ag
>>Af
180
180
e
150
114
112
118
110
120
30
122
130
132
116
116
82
52
22
62
W
P

SELECTIVE STRIPPING APPARATUS

This is continuation-in-part of application Ser. No. 174,431 filed Mar. 28, 1988, now U.S. Pat. No. 4,853,099, dated Aug. 1, 1989 which application is incorporated by reference herein as background information.

BACKGROUND OF THE INVENTION

The invention is directed mainly to gap type electroplating as opposed to tank or bath plating wherein a remotely located anode, either consumable or non-consumable, is placed in a tank with a charged workpiece. Metal is plated onto all surfaces of the workpiece which are in the tank, in accordance with electrolysis technology. To plate only a selected surface in such a tank system, the workpiece must be masked, coated or otherwise shielded from the solution in the tank. Gap type electroplating involves a completely different concept. An anode is provided with a shape and surface generally matching the shape and selected surface of the workpiece being plated. Current flow between the anode and cathode is through a predetermined gap established by the geometry of the anode surface as it relates to the workpiece surface being plated. This type of plating, i.e. gap plating, can be accomplished in a tank and is often done in a plating tank; however, gap plating need not use a tank. It can be performed by directing a plating solution into the gap between the anode and cathode as a current is applied between these two electrodes as long as a closed fluid flow can be made through the gap. This type of gap plating is the main subject of the present invention.

Two examples of the closed circuit gap type plating, to which the present invention is directed, are shown in LaBoda U.S. Pat. No. 4,111,761 and Iemmi U.S. Pat. No. 4,441,976. A somewhat related tank type electroplating process is illustrated in Blanc U.S. Pat. No. 4,345,977. These three patents are incorporated by reference herein as background information since they do contain certain technical descriptions and structures which illustrate the background of the present invention.

As mentioned before, the present invention relates mainly to the art of closed circuit, gap type electroplating as shown generally in LaBoda U.S. Pat. No. 4,111,761 and Iemmi U.S. Pat. No. 4,441,976 wherein an anode having an outer cylindrical surface is fixed concentrically within a cylindrical surface of a workpiece to be plated to define a gap or plating cell. The rest of the workpiece including the complete outer surface is not to be plated. To prevent plating of the remainder of the workpiece, the electroplating solution is not circulated in contact with the area of the workpiece which is not to be plated. In Blanc U.S. Pat. No. 4,345,977, a modified tank system is used. Plating of the outer portion of the workpiece is prevented by seals. The inner cylindrical surface is primarily plated by this apparatus due to anode placement and solution flow; but, other portions of the workpiece are also plated because the tank actually encompasses more than the selected internal surface. This patent is not a gap plating disclosure, but it does show a generally relevant apparatus to plate a selected surface.

The concept of gap plating has been known for many years; however, the fixtures for such processes have been relatively expensive and the results have not been uniform especially in elongated generally inaccessible bores in complex workpieces. For that reason, repair and build up of oversized bores in various workpieces has often been accomplished either by tank plating or brush plating. Tank type plating is extremely slow and does not produce uniform results on only selective surfaces without extensive, expensive masking. Brush type plating depends upon the skill of the operator and can be used for only specific, exposed surfaces. Consequently, there is a substantial demand for a plating system which can plate uniformly, to substantial thicknesses, in excess of 0.050 inches, on various bores of a complex workpiece, such as an aircraft landing gear forging, which system can be done rapidly with low equipment cost by personnel with ordinary skills.

It has become quite desirable to plate in somewhat inaccessible locations of a large workpiece to create an excellent wear resistant, lubricant surface of substantial thickness to reclaim complex workpieces, such as forgings, having only selected surfaces that are worn beyond acceptable tolerances. To satisfy these requirements, chromium cannot always be used because microcracks would be created at the thicknesses which are required to bring an oversized bore into acceptable tolerances. Thus, even though most salvage or repair of selected work surfaces in complex workpieces is done by chromium, chromium is not always an optimum material; therefore, tank plating of such surfaces with chromium is not universally applicable. This is especially true of repairing oversized bores in ultra high strength steel (240 KSI or greater) forgings used in aerospace and aircraft components. In view of these limitations and demands, chromium from tank plating is not completely satisfactory for repairing workpieces, i.e. plating the inner surface of a bore on an ultra high strength steel forging. Chromium plating to repair worn surfaces, even if possible and/or desirable, requires extremely long plating times. Increased current densities to decrease this plating time do not substantially increase the rate at which chromium is deposited because efficiency drops rapidly with increased current density.

In summary, even though tank plating of chromium onto surfaces of a complex workpiece has been used to repair, salvage or re-size surfaces, such process is not completely satisfactory. Indeed, it cannot be used effectively in some situations. Tank plating of nickel is also difficult and costly as a repair, salvage or sizing procedure.

SUMMARY OF THE INVENTION

In view of the many difficulties experienced in attempting to repair worn or oversized bores in complex workpieces such as ultra high strength steel forgings for landing gear assemblies, a plating system was developed which did not require chromium and which could be performed on location without high capital investment, long plating times and trained personnel necessary for the commonly used tank plating system.

The plating apparatus and method of the present invention were created to provide substantial advantages over tank plating for a special application involving selective surfaces to be plated wherein the workpiece itself does not require special treatment and the long plating time necessary in the tank plating is not required. The new apparatus and method rapidly deposits a substantial thickness of metal on a selected surface of a workpiece even though the workpiece has a complex shape while eliminating the need for masking and other complex, tedious, time consuming preplating procedures.

In accordance with the present invention, there is provided an apparatus for either rapidly depositing a layer of metal onto or removing it from a selected surface of the workpiece. This apparatus comprises an electrode or other member having an active surface with a selected shape, combined with the selected shape of the surface of the workpiece to define an elongated gap therebetween of at least 0.050 inches width; means for supporting this electrode or other member in a fixed position to define the elongated gap; solution circulating means for forcing an electroplating solution with metal cations, or a deplating or chemical stripping solution, through the gap in a generally closed path at a velocity to exchange the solution in the gap at a rate of at least 25 times per minute; and, means for applying current flow between the selected workpiece surface and the active surface of the electrode, through the gap, at a current density in excess of 2.0 amperes/in$^2$. This new apparatus is primarily applicable to plating or stripping the plating from an internal cylindrical surface on a generally complex shaped ultra high strength steel forging wherein the gap is annular in cross-section with first and second transverse ends. The electrolyte or stripping solution is forced at ultra high velocity axially through the gap from the first end of the gap toward the second end thereof.

In accordance with another aspect of the invention, the electrode or anode is non-consumable and the plating solution is nickel sulfamate. The rate of flow through the gap can be termed "ultra high velocity" or "ultra high flow" since the flow rate or exchange of liquid through the gap is greater than heretofore employed. Preferably the flow rate is in the range of 200–1,000 times of exchange of solution in the gap per minute. It is anticipated that the ultra high flow can be at least 2,500 times per minute, only limited by the equipment and available pumps. By employing this ultra high volume flow, current densities in excess of 2.0 amperes/in$^2$ can be used between the matching surfaces of the anode and workpiece without overheating the electroplating solution or in any way affecting the uniformity of the plating solution as it flows from one end of the gap to the other end of the gap. This ultra high volume flow assures the removal of gas bubbles, the maintenance of the low temperature and high solution pressure contact with the anode surface and workpiece surfaces. The gap, which defines the plating cell, is at least 0.050 inches in radial width and is preferably between 0.50 inches and 1.0 inches in radial width. Gaps approaching about 2.5 inches can employ the present invention if the volume of flow is increased. In accordance with the invention, a gap is created between the selected surface of a fixed anode and the selected surface to be plated. This gap controls the flow of solution along the surfaces. Ultra high flow rates allow high current densities which, in turn, cause rapid deposition of metal from the flowing plating solution, which is preferably nickel. At any one instance, a fresh plating solution having a controlled temperature and no staleness is available at all areas in the gap for uniform plating while in high pressure contact with the surfaces of the gap. In practice, the plating solution is forced in a vertically upward direction so that any gas generated by the electrolysis in the gap migrates upwardly in the same flow direction as the plating solution is being driven.

The primary object of the present invention is the provision of an apparatus and method for gap plating or deplating, which method and apparatus employs ultra high velocities or flow volumes of plating or deplating solution through the gap. The gap is the plating or deplating cell between a fixed electrode or other member and the specific surface of the workpiece to be plated or deplated.

Another object of the present invention is the provision of an apparatus as defined above, which apparatus can employ current densities exceeding 2.0 amperes/in$^2$ to substantially increase the plating rate and decrease the time of plating, whereby an application which at one time required in excess of three days in a tank can now be done in less than 2–4 hours.

Still a further object of the present invention is the provision of an apparatus, as defined above, which apparatus rapidly deposits a thick metal layer on a selected surface of a workpiece uniformly over the surface in a manner that can be duplicated from workpiece-to-workpiece without the variations caused by limits of manual skills.

Yet another object of the present invention is the provision of an apparatus, as defined above, which apparatus can produce thick, uniform plating surfaces that were heretofore difficult, if not impossible, to obtain by tank plating without substantial fixturing and/or masking.

Another object of the present invention is the provision of an apparatus as defined above, which apparatus employs a swirling flow of plating or deplating solution through the annular gap where the flow is created by the solution itself.

Another object of the present invention is the provision of an apparatus, as defined above, which apparatus can maintain plating solution at a uniform, relatively low temperature throughout the total length of the gap to assure uniformity of plating throughout the gap.

These and other objects and advantages will become apparent from the following description taken together with the accompanying drawings.

DESCRIPTION OF THE PREFERRED EMBODIMENT

Figure 1:
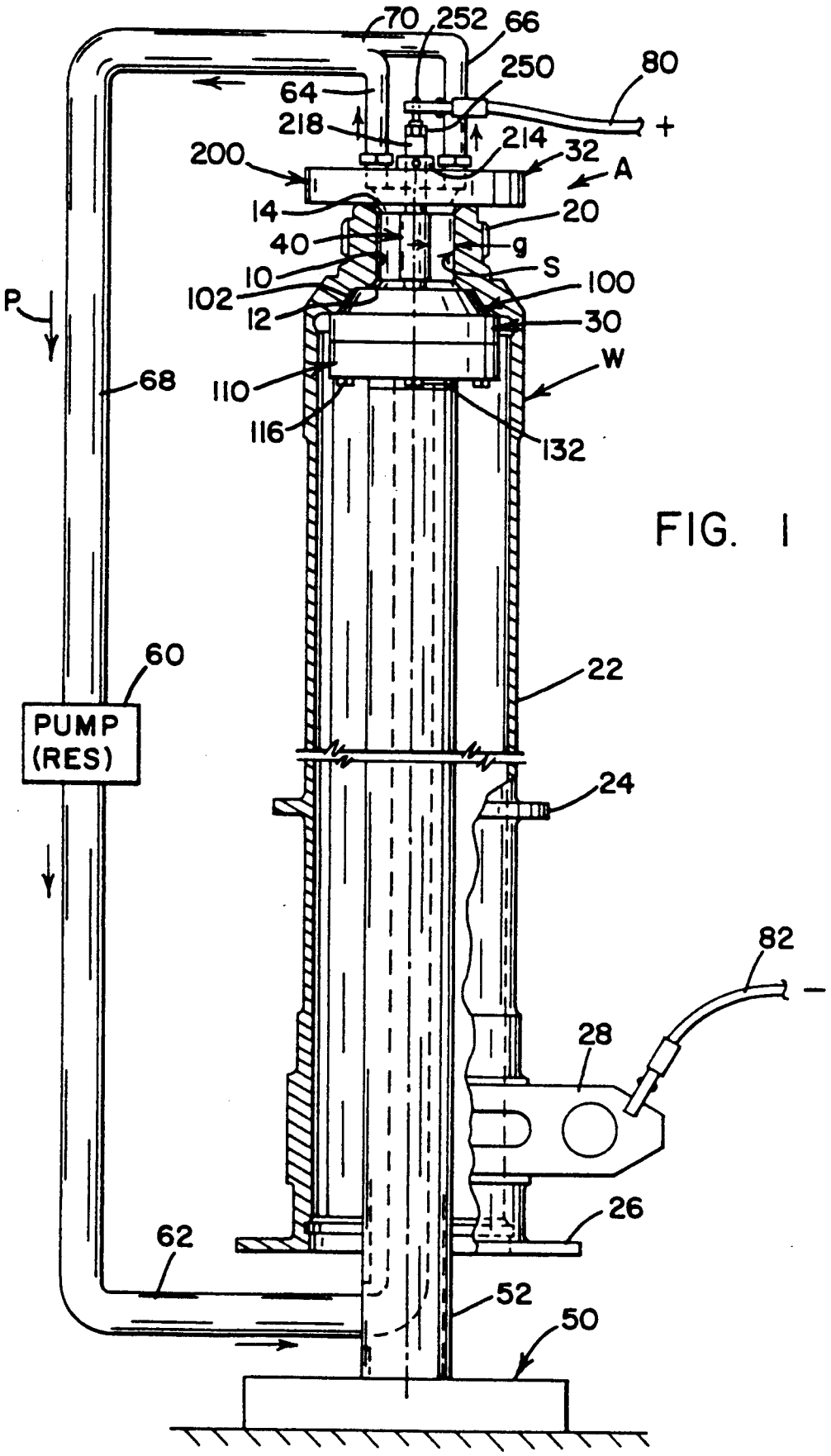
FIG. 1 is a side elevational view showing, somewhat in cross-section, the preferred embodiment of the present invention for use on a particular workpiece.

Referring now to the drawings wherein the showings are for the purpose of illustrating a preferred embodiment of the invention only and not for the purpose of limiting same, FIG. 1 shows an apparatus A constructed in accordance with the present invention for applying a uniform coating of an electroplatable metal, such as nickel, onto a selected surface S in the form of a cylindrical wall 10 having a lower conical relief portion 12 and an upper conical relief portion 14, on a complex workpiece W. For simplicity, this three component selective plating surface will hereafter be referred to as surface S. Although the present invention can be employed for plating on selective surfaces of relatively simple workpiece shapes, one of its distinct advantages is that it may be employed on a complex workpiece represented by workpiece W, which in the illustrated embodiment is an ultra high strength steel landing gear forging wherein surface 10 is a support surface which may be subjected to fretting corrosion and must be repaired by a buildup of metal periodically to restore the usefulness of the total forging. The selectively plated surface S in practicing the present invention, is generally cylindrical, as illustrated on workpiece W, which workpiece example includes many surface areas which are not to be plated, such as the total outside surface including, as examples of the unplated shapes, a gear portion 20, a long sleeve 22, outwardly protruding areas, such as shoulder 24, a lower flange 26, outwardly extending support extension 28 and many other external and internal surface areas which are not to be plated. As can be seen, if this forging W were placed in a plating tank as a cathode, normally the total surface area would be plated to some extent. Consequently, to plate only surface S, a substantial amount of fixturing and masking would be necessary when using a tank plating procedure. In addition, in the past chromium was normally plated on surface S; however, as chromium is plated, even on a selective surface, it requires a substantial amount of plating time. Increased current density does not substantially increase the efficiency and deposit rate of the chromium in a tank or even in a modified tank plating system. Further, chromium is not easily plated to great thickness, such as 0.050 inches. It is advantageous to employ, in this illustrated application, a nickel coating onto surface S. The present invention relates to a process whereby the current density can be increased drastically in a plating process to increase the rate of deposit of a material, such as nickel, onto surface S. The metal preferred will deposit at a rate that increases substantially with increased current density, even though efficiency may be somewhat lower than obtained with low current densities, such as less than about 1.0 amperes/in$^2$.

The present invention relates mainly to an apparatus A which can plate selective surface S with its relief portions 12, 14 using a high current density, in excess of 2.0 amperes/in$^2$, to decrease the plating time necessary to accomplish a predetermined thickness of metal, such as up to over 0.050 inches. In the present invention, a high current density can be maintained; therefore, the layer deposited increases proportionally to the plating time. The invention is particularly applicable for depositing nickel onto the selective surface S, since deposition increases with current density increases without substantial drop off of efficiency as experienced in tank type chromium plating.

Workpiece W is one of many complex forgings which often require internal bores to be rebuilt after wear or when machined oversized. Indeed, in many instances the machining of internal bores on such forgings is intentionally oversized so that a plating layer to the desired bore size can be deposited onto the surface to provide good corrosion resistance, improved wear characteristics and a finer finish. In the past, this salvage or buildup process usually included a tank, or modified tank, plating system for plating chromium or chromium and nickel layers onto the internal surfaces of the bores on the forging. This procedure was extremely time consuming and often required three days in the tank for plating the particular surface S, which is the subject of the illustrated example shown in FIG. 1. In practicing the present invention, by using apparatus A, a coating of nickel on surface S to the same depth and better uniformity has been done in less than 6.0 hours and generally between 2.0 and 6.0 hours. The resulting nickel deposit is uniform, ductile, smooth and can be made thicker than chromium, which is subject to microcracks as the thickness increases. In summary, by employing the present invention, apparatus A can repair, salvage or correct machining errors in a complex workpiece in a relatively short time so that the expensive forging W can be salvaged economically. This saves many such forgings from scrap because, in the past, (a) salvage would often cost more than a new forging (b) salvage would be impossible or (c) forgings could be severely damaged by immersion in tank plating solutions, especially if masking was not done properly.

By using the invention, the same bore on like forgings can be plated with the same apparatus without new fixturing.

Figure 2:
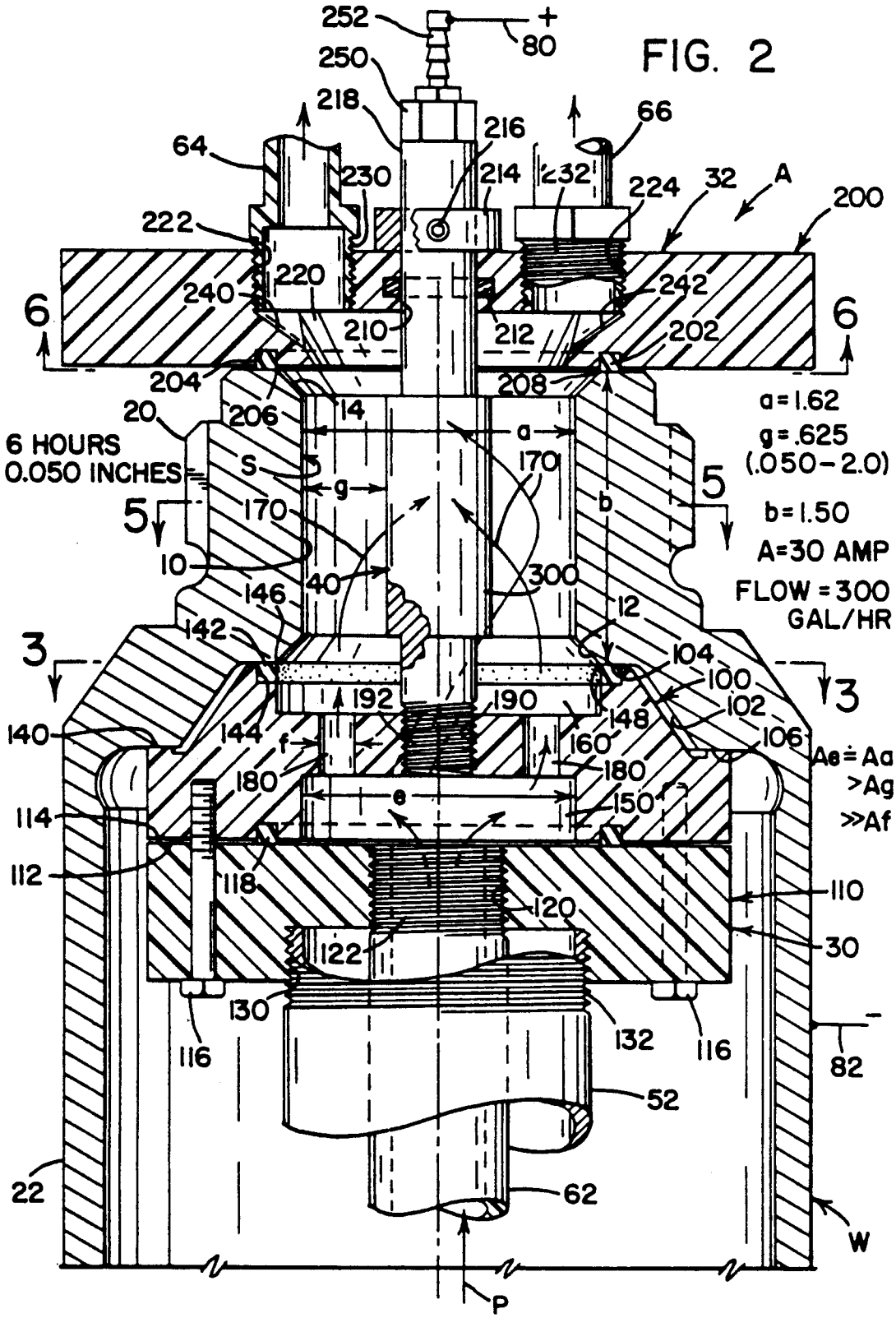
FIG. 2 is an enlarged cross-sectional view illustrating the preferred embodiment of the present invention as shown in FIG. 1 with certain dimensions and parameters used in one example of the present invention.
Figure 3:
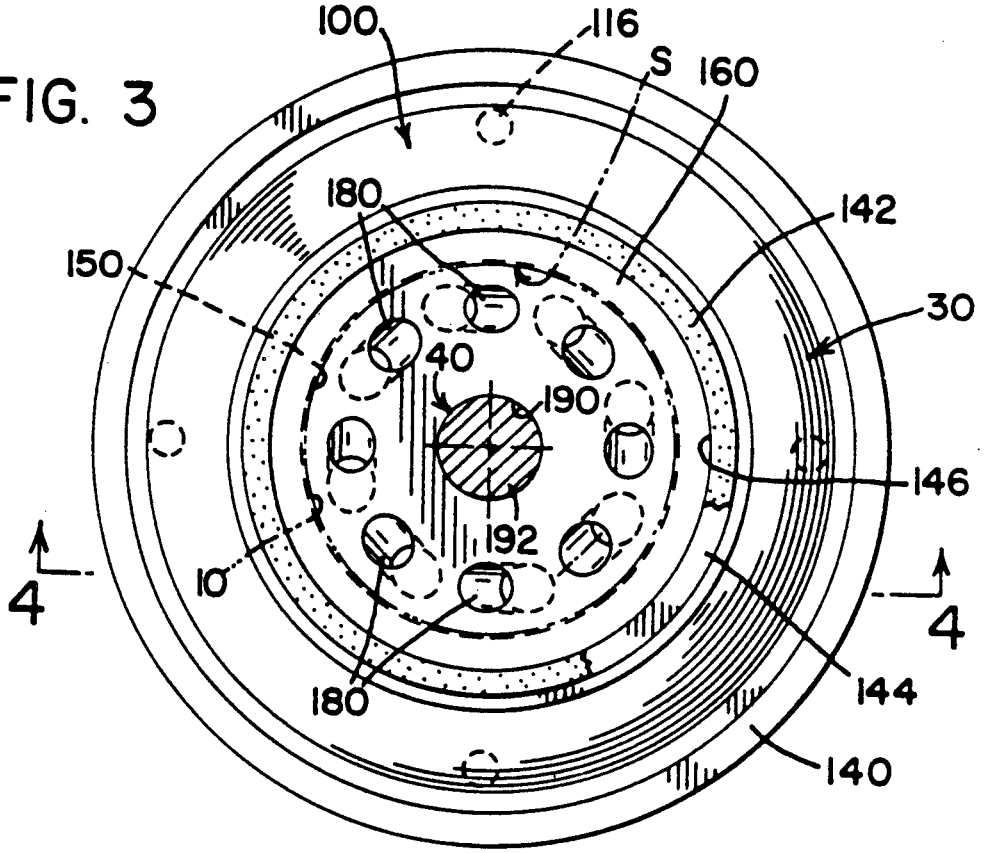
FIG. 3 is a cross-sectional view taken generally along line 3—3 of FIG. 2.

Apparatus A comprises components made for surface S. Other bores or surfaces would require modified, but functionally identical components such as shown in FIG. 2. A lower, or first, end cap 30 engages and seals the gap g, which is the plating cell defined by surface S and anode or center constrictor member 40. An upper, or second, end cap 32 seals the other end of the plating cell at the relief portion 14 of surface S. The end caps are clamped together in sealing engagement with the opposite ends of the surface S by anode 40 concentrically located with respect to surface S and extending axially through the plating cell in a parallel relationship with cylindrical surface 10. To hold workpiece W and the two clamped end caps 30, 32 in a fixed position, an appropriate fixture, illustrated as support stand 50, is provided. This support stand includes an upwardly extending rigid metal tube 52 connecting lower support stand 50 with cap 30, as shown in FIGS. 1 and 2, so that workpiece W and the end caps 30, 32 with surface S sandwiched therebetween are in a fixed position with the first end cap below the second end cap. An ultra high volume liquid pump 60 having a reservoir for the electroplating solution which, in the preferred embodiment is nickel sulfamate, pumps the solution around a closed path P upward through the plating cell defined between end caps 30, 32. This flow is at an ultra high volume. In the illustrated embodiment, liquid pump 60 pumps liquid at 300–700 gallons per hour so that solution flows along the path P as illustrated by the arrows in FIGS. 1 and 2 at a rate to exchange the solution in the plating cell at the rate of 200–1,000 times per minute. In accordance with this invention, the pump has an ultra high volume capacity for fluid flow through the annular gap g at a rate causing a complete change in the liquid at least 25 times per minute. This ultra high volume flow allows nickel to be deposited from the plating solution on surface S using a current density in excess of 2.0 amperes/in$^2$. As the flow rate or velocity increases, the current density can be increased to at least approximately 10.0 amperes/in$^2$ to substantially increase the rate of deposit of nickel from the plating solution onto surface S. Anode 40 is non-consumable; therefore gap g remains constant over the plating cycle which is less than 6.0 hours in the illustrated embodiment. This same deposit of nickel heretofore required about three days of plating in a tank plating system, if obtainable at all.

To direct the ultra high volume or ultra high flow fluid along the closed path P, pump 60 feeds the nickel sulfamate or other similar plating solution into an high pressure plastic feed line 62 which extends upwardly through tube 52 and into lower end cap 30. The flow along path P then moves upwardly through the plating cell, defined by surface S and anode 40, and exits through upper end cap 32 into a pair of discharge lines 64, 66 which feed into a larger feed line 68. The use of two diametrically spaced discharge lines 64, 66 distributes the exit flow more evenly through upper end cap 32 to prevent cavitation and assure smooth flow of the plating solution through the actual plating cell. In accordance with standard practice and from a standard portable plating supply, D.C. current is passed through annular gap g by an anode lead 80 connected to anode 40 and a cathode lead 82 connected to workpiece or forging W. In practice, a cathode is connected adjacent end caps 30, 32 of apparatus A by placing a clamp around workpiece W in the vicinity of surface S. The particular structure for causing a current to flow through fixed, annular gap g does not form a part of the invention and can be accomplished by various electrical connections.

In operation, the current flow between leads 80, 82 is adjusted to produce the desired plating rate, which in obtaining the maximum benefit of the present invention is extremely high, at least about 2.0 amperes/in$^2$. The current density can be increased as the flow rate from pump 60 is increased. The pumps now available produce about 300–800 gallons/minute and provide an ultra high volume flow, as indicated above, to exchange the electroplating solution in gap g at least about 200 times per minute.

Lower end cap 30 is constructed to assure even distribution of the plating solution through gap g at the ultra high flow rates; consequently, all areas of the cylindrical anode surface and surface S are evenly and uniformly supplied continuously with a fresh plating solution in intimate, high pressure, direct, uninterrupted, physical and electrical surface contact. To accomplish this objective, end cap 30 includes a nose 100 having an outer contour specially shaped and sized to engage and match contour 102 of workpiece W. In the illustration, this contour has annular, concentric shoulders 104, 106 which form a part of the unique design of the workpiece. These shoulders are concentric with surface S and dictate the contour of nose 100 formed for the illustrated bore. A second component, i.e. lower base 110, is clamped to nose 100 at parallel, laterally extending surfaces 112, 114 by a plurality of spaced bolts 116 used to draw nose 100 and base 110 together. An O-ring 118 seals the internal passageways of cap 30 which passageways receive high pressure plating solution flowing at an ultra high volume flow rate through feed line 62. The solution moves through cap 30 as indicated by the arrows in FIG. 2. Base 110 has a center threaded bore 120 adapted to receive threaded end 122 of feed line 62 for connecting this high pressure line onto base 110. A concentric, second threaded bore 130 receives threaded end 132 of rigid support tube 52 for supporting apparatus A and the workpiece W in a vertical position.

Referring now to nose 100, this component includes the basic passageways of lower end cap 30 and includes an outwardly facing shoulder 140 adapted to abut concentric shoulder 106 of workpiece W for the purposes of aligning cap 30. A square cross-sectioned O-ring 142 is received in recess 144 of nose 100 so that outer, circular edge 146 matches edge 148 at the extreme end of conical recess portion 12 in a manner that edge 146 defines the outermost plating area for the plating cell. Edges 146, 148 can be accurately located with respect to each other by manually moving workpiece W on nose 100 before anode 40 clamps upper end cap 32 into position. The internal passageways of cap 30 include a concentric plenum chamber 150 having a diameter e and a height of about ½ inch. Diameter e is generally the same as diameter a of cylindrical portion 10 of surface S so that a large volume of solution from feed line 62 can accumulate in the plenum chamber 150 directed from the plenum chamber into a distribution cavity 160 at the upper, exposed end of nose 100. By providing a plenum chamber and a distribution cavity, ultra high volume flow can be distributed by the cavity after being evenly pressurized in the plenum chamber.

Figure 4:
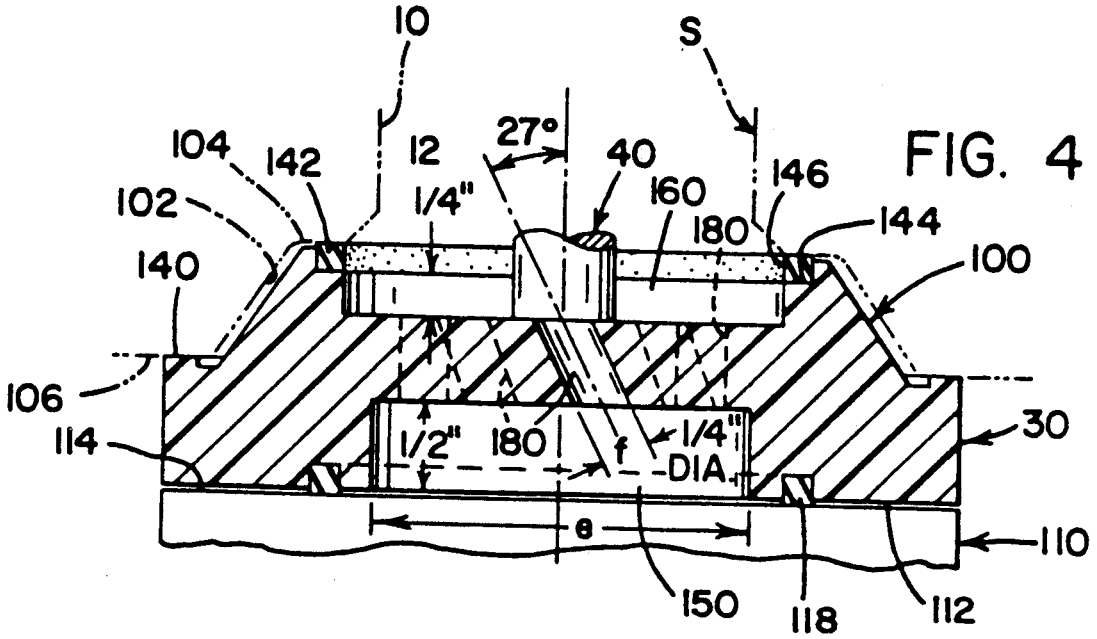
FIG. 4 is a cross-sectional view taken generally along line 4—4 of FIG. 3.
Figure 5:
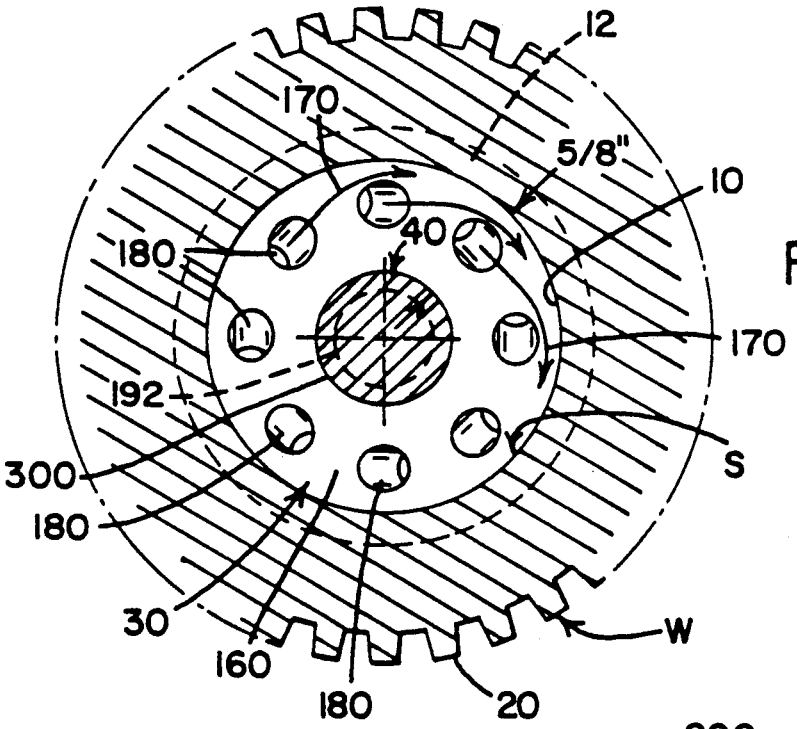
FIG. 5 is a cross-sectional view taken generally along line 5—5 of FIG. 2.

In accordance with another aspect of the present invention, there is provided a novel nozzle means for moving the solution between lower plenum chamber 150 and upper distribution cavity 160. This nozzle means creates a plurality of separate and distinct spirally configured streams of plating solution 170, shown schematically as spirally configured arrows in FIG. 2. The nozzle means for accomplishing this spirally configured flow through annular gap g is in the form of a plurality of circumferentially spaced holes or bores 180, eight of which are shown evenly spaced in a circumference. These holes are at a vertical angle of approximately 30° and (in practice 27°) so that the liquid streams 170 are directed into the gap g and not against either anode 40 or surface S. In this fashion, the jet or streams of plating solution point axially through gap g generally at the center of the gap to prevent anything except normal even rapid flow of liquid along the surface of the anode and the surface being plated. The unique spiral configuration, which is preferred, increases the surface velocity of the solution to a level even greater than the exchange velocity created by pump 60. The actual velocity through the plating cell or gap is determined by the distance the solution moves and the time the solution requires to pass through the gap. The velocity through the cell is even greater than the ultra high velocity created by the ultra high flow rate. Holes 180 in the preferred embodiment are approximately ¼ inch in diameter as schematically represented as distance f in FIGS. 2 and 4. A central threaded bore 190 receives threaded end 192 of anode 40 for connecting lower end cap 30 onto the anode for supporting the lower end of the anode of apparatus A when the two caps are in position for plating. As illustrated in FIG. 2, nose 100 and base 110 are formed from appropriate plastic material which is non-conductive and provides an insulation between positive anode 40 and negative workpiece W.

Figure 6:
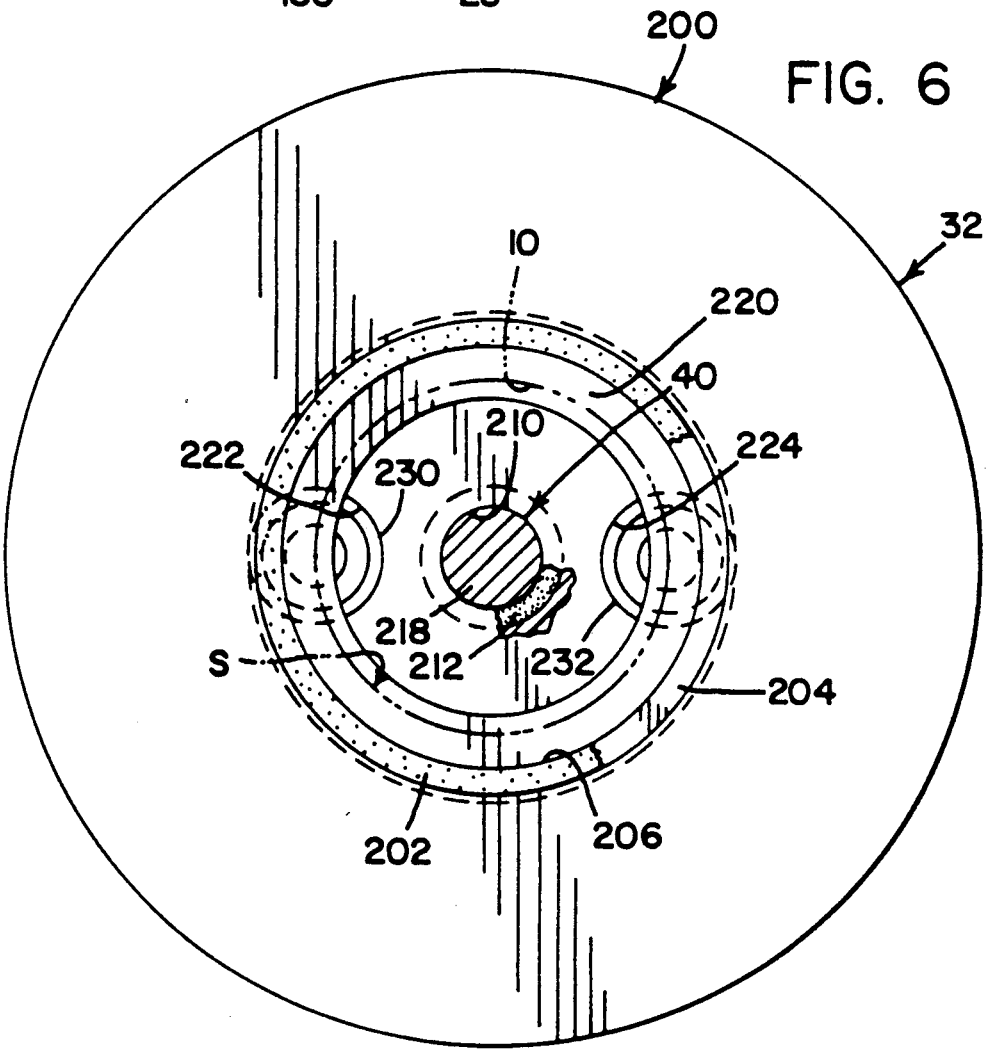
FIG. 6 is a cross-sectional view taken generally along line 6—6 of FIG. 2.

Referring now to FIGS. 2 and 6, upper end cap 32 includes a generally flat plastic body having a circular, downwardly extending square cross-sectioned O-ring 202 in circular recess 204 to define an innermost edge 206 corresponding with outermost edge 208 of conical relief portion 14 to be plated. O-ring 202 has the same function as O-ring 142 of the lower end cap so that these square O-rings define the outermost extent of the selective surface to be plated during operation of apparatus A. For the purpose of assembling the two end caps, body 200 includes a center opening 210 for receiving cylindrical shaft 218 of anode 40. A standard O-ring 212 is mounted within opening 210 for sealing between this opening and shaft 218 of the anode which can slide in the opening. An upper collar 214 is fixedly secured onto shaft 218 by an appropriate means, such as set screw 216. The passageways for electroplating solution in upper cap 32 is designed to accumulate any gas which may be generated during the plating process. The gas will, by buoyancy, migrate upwardly from cap 30 toward cap 32. For the purpose of accumulating liquid after the plating operation, and to provide a collector for any vapor created during the plating process, body 200 includes an outwardly flaring conical, upper collector cavity 220 having a generally flat upper surface intersecting two spaced bores 222, 224 for receiving the threaded nipple portions 230, 232 of discharge lines 64, 66, respectively. These lines have relatively large areas and must be spaced from anode 40; therefore, bores 222, 224 intersect downwardly conical surfaces 240, 242 forming an oblique intersection with the conical surface forming cavity 220, as best illustrated in FIGS. 2 and 6. In this manner, the solution flowing through gap g is collected in cavity 220 which increases in transverse size in the direction perpendicular to movement of path P. Consequently, the velocity of the solution is reduced in cavity 220 for distribution through discharge lines 64, 66. This outward flaring, reduced velocity portion allows accumulation of any gases which are formed during the plating process; but, the increase in size over the area of surface 10 is not sufficient to cause a substantial reduction in velocity at cavity 220.

To assemble apparatus A, as shown in FIG. 2, end 192 of anode 40 is threaded into bore 190 of lower end cap 30. Workpiece W is then centered on square O-ring 142 and positioned so that edges 146, 148 match. Then body 200 is slipped over shaft 218 of the anode. The body is moved downwardly in a centered position to match edges 206, 208. Collar 214 is then locked on shaft 218 by set screw 216. Then by an upper wrench portion 250, anode 40 is rotated to clamp the end caps together by threading bottom portion 192 into threaded bore 190 of the lower end cap. Thereafter an appropriate anode connection 252 is snapped into the top of the anode and the anode and cathode leads are connected. To start the process, pump 60 forces the plating solution through the plating cell as shown by the arrows in FIG. 2 while current is applied through the annular gap g. The plating process continues until the desired thickness of the plating metal has been obtained.

Figure 7:
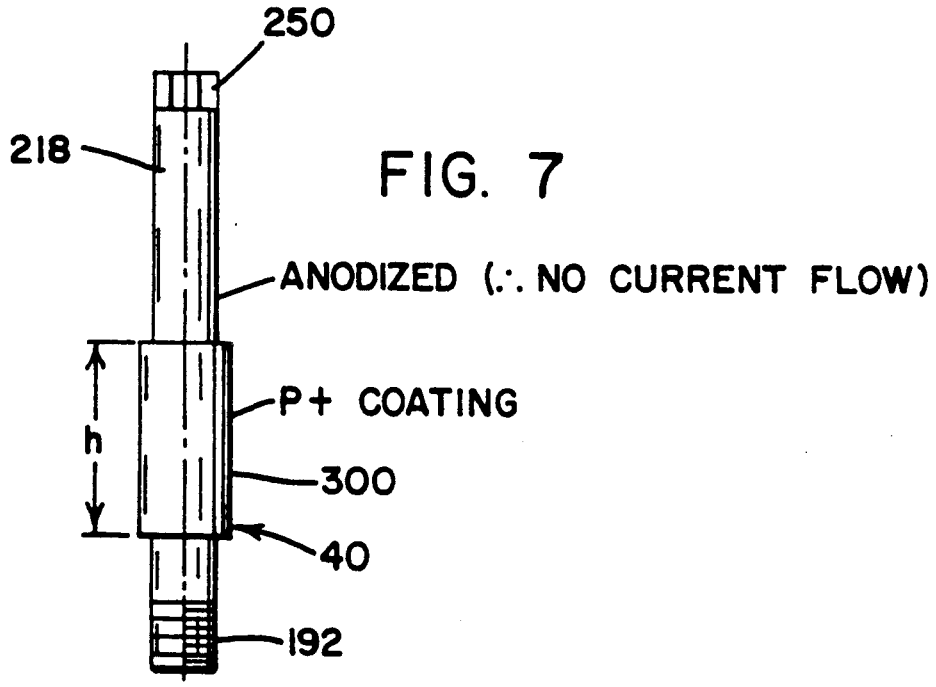
FIG. 7 is a side elevational view of the electrode or anode employed in the preferred embodiment of the present invention.

Referring now to FIG. 7, anode 40 used in the preferred embodiment of the present invention is illustrated. A standard platinum coated titanium anode rod is machined to produce the selected area of section 300 which matches the selected surface S to be plated. In accordance with one aspect of the invention, surface 10 is cylindrical; therefore, surface or selected portion 300 is cylindrical and has a length h matching the length of surface S to be plated. As soon as the plating process is initiated, the portions of anode 40 exposed except in area 300 are titanium which is anodized and therefore creates no current flow. Thus, current flows only from surface 300, which matches surface S to be plated. Anode 40 is, in accordance with one aspect of the invention, non-consumable so gap g remains constant and allows continuous and uniform flow through the plating cell without changes caused by depletion of the anode.

Figure 8:
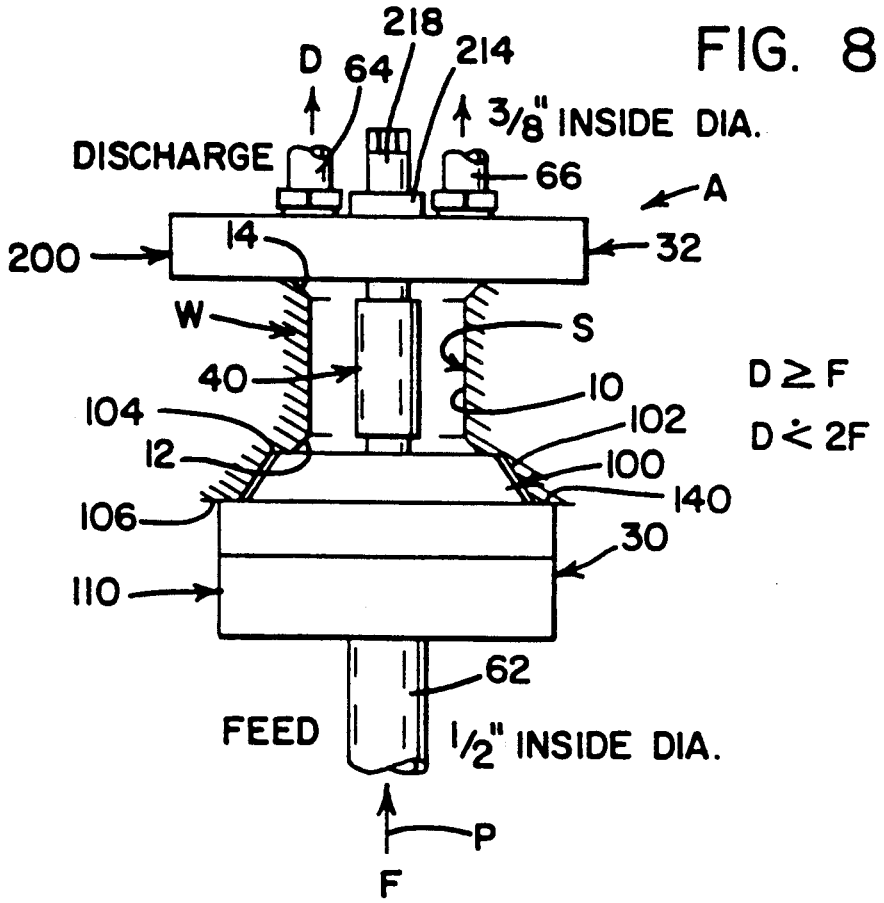
FIG. 8 is a schematic view illustrating certain flow characteristics of the preferred embodiment of the present invention; and, FIG. 9 is a graph showing one operating parameter obtained by employing the present invention.

FIG. 8 is a schematic representation of another aspect of the invention. The solution flow along path P from the feed end F to the discharge end D between end cap 30 and end cap 32 is controlled to maintain rapid and positive exchange of plating solution through gap g. To do this, the area or restriction of discharge lines 64, 66 is greater than the area or restriction of feed line 62; however, the combined area of the discharge lines is not more than two times the area of the feed line. In this manner, the solution flow is controlled through the plating cell to prevent a decrease in velocity in the cell due to enlargement of cross-sectional areas in the flow pattern through the cell. There will be no back pressure in view of the fact that the discharge area is at least as great as the feeding area. There is no substantial reduction in velocity since the discharge area is not more than about twice the feed area. This is another aspect of the present invention assisting in the uniform and continuous flow of plating solution through annular gap g.

EXAMPLE 1

The parameters set forth on FIG. 2 and discussed above represent one example of the present invention. The surface 10 has a diameter 1.62 inches and gap g is 0.625 inches. In practice, this gap is between 0.050–2.0 inches. The length of surface S is 1.50 inches and the current flow is about 30 amps. Three hundred gallons of a nickel sulfamate plating solution is pumped through gap g each hour. The area Ae of plenum chamber 150 is about equal to the cross-sectional area Aa of surface 10; however, it is, therefore, greater than the cross-sectional area of gap g and substantially greater than the combined area Af of the various holes 180 of the nozzle creating means. This example allows a deposit of nickel at the desired thickness with a plating cycle between 2.0 and 6.0 hours whereas tank plating of the same surface using chromium to the same thickness, if that were possible, would require over three days.

Figure 9:
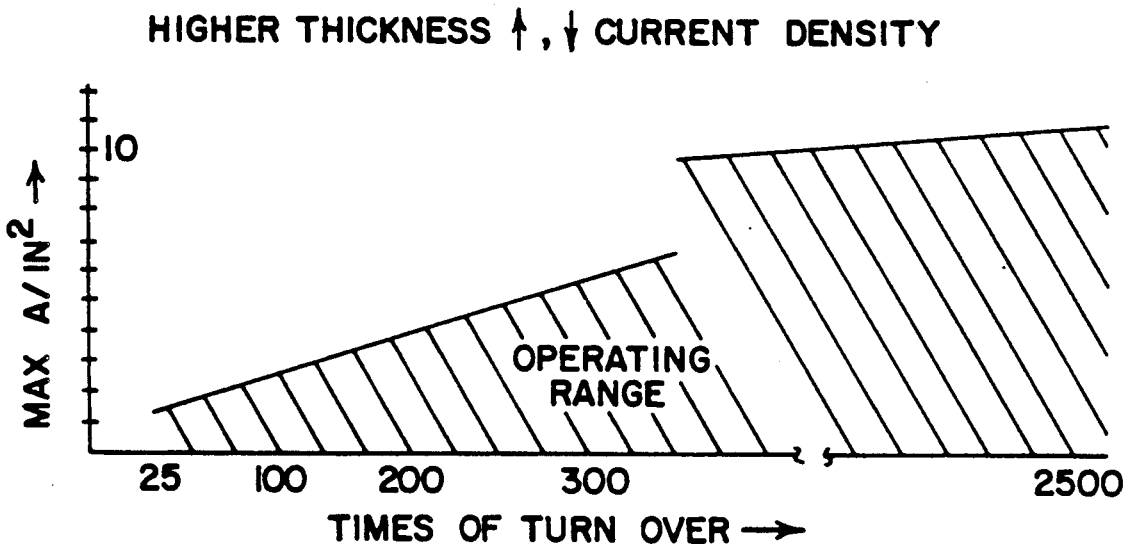

In accordance with the invention, the exchange rate of plating solution in gap g is at least 25 times per minute. This is illustrated in a general fashion by the graph of FIG. 9 where the maximum current density is increased as the exchange rate increases. This relationship defines an operating range that progresses toward 10 or more amperes/in$^2$ as the exchange rate increases toward 2500 times/minute. Of course, the current density used in the process is not necessarily the maximum current density since other parameters of the process determine the exact current density which is desired by the individual operator for a specific workpiece being processed. The desired current density may be determined by the size of the gap, the temperature, if any, in the gap and related parameters not forming a part of the invention. In accordance with the invention, the ultra high flow rate is created so that the plating can be accomplished by merely employing two separate closures, or end caps, to define the plating cell and forcing plating solution through the gap between the anode and selected surface to be plated at a high rate to allow the high current densities. In practice, the plating solution is a nickel solution and preferably nickel sulfamate. The temperature is maintained in the gap within the range of 100° F.-130° F.

In accordance with a main aspect of the invention, the surface 10 is cylindrical and the surface 300 of anode 40 is cylindrical and formed on a non-consumable anode. The plating solution may be any of the various plating solutions used in selective plating processes of the non-tank type. Chromium is not generally employed in this type of process. The solutions normally anticipated in selective plating processes are nickel, lead, copper, iron, tin and zinc. Of course, the noble metals could be employed; however, this present invention is primarily applicable for industrial uses which do not envision use of the noble metals. Chromium presents difficulties in employing the present invention in that plating must be done slowly and the advantages obtained by the rapid flow are not fully realized in chromium plating. Chromium deposits are brittle and limited in thickness which distracts from the usefulness of the present invention. In all instances, chromium would present difficulties using the present invention and for that reason it is not anticipated; however, some of the features of the present invention may assist in providing some benefit for a chromium plating system. Nickel is envisioned as the preferred and best metal to be employed in practicing the present invention.

By using apparatus A, the solution flow is confined to the surface to be plated and the surface of the anode. There is no need for varnish or other insulating coating to prevent unwanted plating. The workpiece W can be of various shapes. By providing the high volume flow, there is a constant solution/metal interface at the anode surface 300 and surface S being plated. There is no liquid spray of the solution and other auxiliary inputs to the gap g which can distract from the evenness of the solution rapidly flowing axially through the gap. There is a decrease in any tendency to vaporize the solution. There is a maintained high surface pressure between the solution and both the anode surface and surface S so that there is an extremely intimate liquid/metal interface with the flowing solution. Gap g need not be accurately controlled as long as it is generally uniform in cross-section to not interrupt the high pressure, surface contact of the liquid solution passing axially through the gap. The gap should not have areas which accumulate solution or decrease the velocity of the solution as it is moving through the gap. Such decrease in velocity is quite common in tank plating and causes stagnation and accumulation of lower strength plating solution in contact with certain portions of the surface being plated.

In addition, flow in accordance with the present invention, is vertically upward to be concurrent with the flow of any gas vapors created during the plating operation. The term "ultra high" volume as it relates to the rate of circulation, means over 25 exchanges of solution in the gap g per minute and preferably more than about 200 exchanges per minute. The anode construction of the present invention is geometrically matched to the surface 10 as distinguished from a tank plating process where the anode may be remote to the surface and may have no real geometric relationship therewith. The anode surface coacts with surface S to define the gap through which the ultra high fluid flow occurs. This is a unique plating process and quite distinct from any tank or normal gap type plating process. By employing a lower plenum chamber 150 in cap 30, the incoming liquid is evenly distributed before jetting through high velocity holes 180. This change in velocity at the jets assures that the individual jets created by the circumferentially spaced holes drive through the gap in a direction between the plating surface and the anode surface. By creating each jet as a swirl or spiral, the liquid velocity increases through the gap because the solution passes through a greater distance in moving from cap 30 to upper cap 32.

By using the gap concept, repeatability from one workpiece to the next is obtained. Of course, each workpiece would have its own specially designed fixture. This fixture is portable with the plating solution pump and portable power supply. The solution passes in a closed system and may be replenished periodically after a preselected amount of use. The invention provides a uniform plating through the total gap and does not have areas of stagnation, increased temperature or low flow rates. This advantage is obtained by high solution exchange rates which are limited primarily by the equipment strength and design and may be as high as 2500 exchanges per minute, as illustrated graphically in FIG. 9. The anode is shaped to conform with the selected plating shape, is insoluble, and passes current only from the selected area, such as surface 300 shown in FIGS. 2 and 7. The rest of the anode is prevented from acting as a current source by anodizing the surface during initial use of the anode. Thus, there is an even current flow through the gap between surface 300 and surface S to be plated.

While the apparatus A according to the invention has been specifically described hereinabove in connection with the electroplating of a layer of metal such as nickel onto the surface 10 of a steel forging or workpiece W, it can be effectively used as well for removing a worn metal plating from the surface 10 of such workpieces either by electrolytic or chemical stripping of the metal layer from the surface 10. The use of the apparatus for electrolytic stripping requires the use of reverse electrolysis from that employed for electroplating, the workpiece W serving instead as an anode and the electrode 40 serving as the cathode. The electrolyte stripping solution employed in such case must be capable of removing the coating or plating without causing damage to the base material of the workpiece. The expected application of this electrolytic stripping apparatus would be the removal of chromium plating from a steel or nickel plated steel workpiece W. A typical example for such electrolytic stripping process would be as follows.

EXAMPLE 2

The workpiece W is a landing gear cylinder or forging W of ultra-high strength steel having a 2 inch diameter bore 10 approximately 2 inches long and provided with a chromium plating approximately 0.001 inch thick. The electrode or center constrictor member 40 is of stainless steel, and D.C. current is passed through annular gap g from a standard portable power supply by an anode lead 80 connected instead to the workpiece or forging W so that it serves as an anode and by a cathode lead 82 connected instead to the electrode 40 so that it serves as a cathode. A standard alkaline, electrolytic stripping solution such as a sodium hydroxide and water solution containing approximately 60 grams of sodium hydroxide per liter, or a sodium carbonate and water solution containing approximately 75 grams of sodium carbonate per liter, is pumped through the gap g at a comparatively low volume and with lower flow rates than employed for electrolytic plating as described in Example 1, to create a complete solution exchange rate in the gap g at least from 25 to 1,000 times per minute. The applied voltage ranges from 5 to 15 volts, and a high current density of at least 3.0 amperes per inch$^2$ and up to around 12 amperes per inch$^2$ is employed. The operating temperature of the solution under these processing conditions ranges from 70°–130° F. The stripping rate produced by such a gap type stripping operation according to the invention is from 50% to 500% faster than conventional tank type stripping methods.

The use of the apparatus for chemical stripping involves the use of a treating solution that will remove the plating by chemical means as by dissolving it instead of by electrolytically removing it. Examples of this chemical stripping method would be removal of nickel and/or copper plating from steel, silver from copper, tin from brass, nickel from aluminum, etc. The solution employed must not damage or dissolve the base material. A typical example of employing the apparatus A according to the invention to chemically strip nickel plating from steel would be as follows.

EXAMPLE 3

The workpiece W is a landing gear piston of ultra-high strength steel having a 1 inch diameter bore in the wall approximately 0.125 inches long and provided with a nickel plating approximately 0.005 inch thick. Since no electrolytic action is involved in the chemical stripping operation, no electrode 40 is necessary in using the apparatus A for such type stripping process but a center constrictor member 40 is employed to define the gap g. A standard alkaline, cyanide or non-cyanide nickel stripping solution such as a water based solution comprised of approximately 75 grams of sodium cyanide per liter of solution, 15 grams of sodium hydroxide per liter of solution, and 30 grams of m-nitrobenzene sulfonic acid per liter of solution, is pumped at an operating temperature of from 90°–150° F. through the bore of the piston workpiece at a comparatively low volume and with lower flow rates than employed for electrolytic plating as described in Example 1, to create a complete solution exchange rate in the bore at least from 25 to 1,000 times per minute. The stripping rate produced by such a chemical stripping operation according to the invention is from 50–250% faster than conventional tank type chemical stripping methods.

The major advantages of stripping the plating on bores by the use of substantially the same apparatus A as is used to electroplate the bore is speed of operation and cost savings. Since fixtures are already made for the apparatus A to electroplate a particular bore, only minor fixture modifications are necessary to adapt the apparatus for stripping capabilities. Also, proprietary stripping solutions such as are used in tank type stripping methods are costly, and have limited service life, often deteriorating without use. Conventional tank type stripping methods, moreover, usually require the use of comparatively large size tanks to process the parts. In contrast thereto, stripping by the use of the apparatus A comprising the invention can usually be accomplished with as little as one gallon of solution.

Selective masking of the workpiece provided by apparatus A assures that the workpiece cannot be damaged during the stripping operation such as is a common occurrence in tank type stripping operations. Most importantly, by the use of the apparatus A according to the invention, coatings or platings on metal articles are stripped from 50 to 500% faster than coatings stripped by conventional tank type methods.

Having thus described the invention it is claimed:

1. An apparatus for stripping a metal plating from a selected wall surface of a bore in a workpiece, said apparatus comprising: a cylindrical center constrictor member disposed in a fixed position, means supporting said constrictor member in said fixed position, means for mounting said workpiece with its said bore wall surface surrounding and extending axially concentric of said constrictor member to define therewith an annular gap of at least 0.050 inches therebetween; and solution circulating means for forcing a stripping solution, capable of accepting the metal of the said plating on said bore wall surface, through said gap in a generally closed path at an ultra-high velocity to exchange solution in said gap at a rate of at least 25 times per minute.

2. An apparatus as defined in claim 1, wherein said selected bore wall surface is an internal cylindrical surface and said gap is generally annular in cross-section with first and second transverse ends.

3. An apparatus as defined in claim 2, and further including a first end cap over said first end of said gap and a second end cap over said second end of said gap, said end caps comprising said constrictor member support means and including passageways comprising a portion of said closed path for said solution circulating means.

4. An apparatus as defined in claim 3, wherein said closed path is in a generally vertical upward direction when in said gap.

5. An apparatus as defined in claim 4, wherein said first end cap is on the inlet end of said gap and includes passageways comprising a stripping solution inlet, a plenum chamber communicated with said solution inlet and nozzle means for directing several axially extending streams of said solution from said plenum chamber into said gap.

6. An apparatus as defined in claim 5, wherein said nozzle means includes means for directing said several axial streams in a spiral pattern axially through said gap.

7. An apparatus as defined in claim 6, wherein said nozzle means includes means for creating said several streams circumferentially spaced around said gap.

8. An apparatus as defined in claim 5, wherein said nozzle means includes means for creating said several streams circumferentially spaced around said gap.

9. An apparatus as defined in claim 3, wherein said first end cap is at the inlet end of said gap and includes passageways comprising a stripping solution inlet, a plenum chamber communicated with said solution inlet, and nozzle means for directing several axially extending streams of said solution from said plenum chamber into said gap.

10. An apparatus as defined in claim 7, wherein said nozzle means includes means for creating said several streams circumferentially spaced around said gap.

11. An apparatus as defined in claim 9, wherein said nozzle means includes means for creating said several streams circumferentially spaced around said gap.

12. An apparatus as defined in claim 7, wherein said nozzle means includes means for directing said several streams in a spiral pattern axially through said gap.

13. An apparatus as defined in claim 2, wherein said closed path is in a generally vertical upward direction when in said gap.

14. An apparatus as defined in claim 1, wherein said closed path is in a generally vertical upward direction when in said gap.

15. An apparatus for electrolytically stripping a metal plating from a selected surface of a workpiece, said apparatus comprising: a cathode having an active surface with a selected shape, means for supporting said cathode in a fixed position, means for mounting said workpiece with its said selected surface in spaced relation to said active surface of said cathode to define therewith an elongated gap of at least 0.050 inches therebetween; solution circulating means for forcing a stripping solution, capable of electrolytically stripping the said metal plating, through said gap in a generally closed path at a velocity to exchange stripping solution in said gap at a rate of at least from 25 to 1,000 times per minute; and means for applying electric current flow between said selected workpiece surface and the active surface of said cathode through said gap at a current density of at least 3.0 amperes/in$^2$.

16. An apparatus as defined in claim 15, wherein said workpiece is composed of steel and said metal plating is composed of chromium, and said stripping solution is comprised of a water based solution containing approximately 60 grams of sodium hydroxide per liter and approximately 75 grams of sodium carbonate per liter.

17. An apparatus as defined in claim 15, wherein said active surface of said cathode is cylindrical and said selected surface of said workpiece is an internal cylindrical surface surrounding and extending axially concentric of said cathode active surface and said gap is generally annular in cross-section with first and second transverse ends.

18. An apparatus as defined in claim 17, and further including a first end cap over said first end of said gap and a second end cap over said second end of said gap, said end caps comprising said cathode support means and including passageways comprising a portion of said closed path for said solution circulating means.

19. An apparatus as defined in claim 18, wherein said first end cap is at the inlet end of said gap and includes passageways comprising a stripping solution inlet, a plenum chamber communicated with said solution inlet, and nozzle means for directing several axially extending streams of said solution from said plenum chamber into said gap.

20. An apparatus as defined in claim 17, wherein the said workpiece is composed of ultra-high strength steel and the said metal plating is composed of nickel, and the said stripping solution is a water based solution comprised of approximately 75 grams of sodium cyanide per liter of solution, 15 grams of sodium hydroxide per liter of solution, and 30 grams of m-nitrobenzene sulfonic acid per liter of solution.

21. An apparatus for chemically stripping a metal plating from a selected wall surface of a bore in a workpiece, said apparatus comprising: a cylindrical center constrictor member disposed in a fixed position, means supporting said constrictor member in said fixed position, means for mounting said workpiece with its said bore wall surface surrounding and extending axially concentric of said constrictor member to define therewith an annular gap of at least 0.050 inches therebetween; and solution circulating means for forcing a stripping solution, capable of dissolving the metal of the said plating on said bore wall surface, through said gap in a generally closed path at an ultra high velocity to exchange solution in said gap at a rate of at least from 25 to 1,000 times per minute.

22. An apparatus as defined in claim 20, wherein said gap is generally annular in cross-section with first and second transverse ends, and said apparatus further includes a first end cap over said first end of said gap and a second end cap over said second end of said gap, said end caps comprising said constrictor member support means and including passageways comprising a portion of said closed path for said solution circulating means.

23. An apparatus as defined in claim 22, wherein said first end cap is at the inlet end of said gap and includes passageways comprising a stripping solution inlet, a plenum chamber communicated with said solution inlet, and nozzle means for directing several axially extending streams of said solution from said plenum chamber into said gap.

* * * * *